US009061539B1

(12) United States Patent
Parkinson et al.

(10) Patent No.: US 9,061,539 B1
(45) Date of Patent: Jun. 23, 2015

(54) GREETING CARD WITH SCROLLING SCENE

(71) Applicant: American Greetings Corporation, Cleveland, OH (US)

(72) Inventors: Michelle Parkinson, Garfield Heights, OH (US); Erin Dennis, Lakewood, OH (US)

(73) Assignee: American Geetings Corporation, Cleveland, OH (US)

( * ) Notice: Subject to any disclaimer, the term of this patent is extended or adjusted under 35 U.S.C. 154(b) by 0 days.

(21) Appl. No.: 14/559,203

(22) Filed: Dec. 3, 2014

Related U.S. Application Data

(60) Provisional application No. 61/919,515, filed on Dec. 20, 2013.

(51) Int. Cl.

| | |
|---|---|
| ***B42D 15/02*** | (2006.01) |
| ***B42D 15/04*** | (2006.01) |
| ***B42D 19/00*** | (2006.01) |
| ***G09F 11/26*** | (2006.01) |

(52) U.S. Cl.
CPC ..... *B42D 15/047* (2013.01); *B42D 15/022* (2013.01); *B42D 15/04* (2013.01); *B42D 19/005* (2013.01); *G09F 11/26* (2013.01); *B42D 15/02* (2013.01)

(58) Field of Classification Search
CPC ..... B42D 15/02; B42D 15/022; G09F 11/26
See application file for complete search history.

(56) References Cited

U.S. PATENT DOCUMENTS

| | | | | |
|---|---|---|---|---|
| 1,082,311 | A * | 12/1913 | Fielding | 40/472 |
| 2,071,288 | A * | 2/1937 | Thompson | 40/525 |
| 2,104,105 | A * | 1/1938 | Schmidt | 40/438 |
| 3,552,049 | A * | 1/1971 | Foote | 40/472 |
| 4,255,889 | A | 3/1981 | Logan | |
| 5,105,185 | A * | 4/1992 | Nakanowatari et al. | 345/94 |
| 5,515,631 | A | 5/1996 | Nardy et al. | |
| 5,942,706 | A | 8/1999 | Leckie | |
| 2002/0095835 | A1 | 7/2002 | Vanderburg | |
| 2006/0209260 | A1 * | 9/2006 | Clegg | 352/98 |
| 2011/0078931 | A1 * | 4/2011 | Sapp et al. | 40/124.03 |
| 2013/0139418 | A1 * | 6/2013 | Bogdanski et al. | 40/124.03 |
| 2014/0259817 | A1 * | 9/2014 | Reynolds et al. | 40/124.02 |

* cited by examiner

*Primary Examiner* — Gary Hoge
(74) *Attorney, Agent, or Firm* — Christine Flanagan

(57) ABSTRACT

The greeting card of the present invention includes a sound and motor module which enable the greeting card to play audio and activate a scroll mechanism which displays a scrolling scene across a window or screen located on at least one panel of the greeting card. The scroll mechanism contains a piece of thin paper or paper-like material which is attached end-to-end, forming a loop. The material is then placed between two rotating spindles or rollers which rotate the material in a loop across the greeting card page as a moving picture, scene or message. The scroll may contain a greeting, message or simply contain artwork or a funny or entertaining scene. The information on the scroll may be coordinated with the theme of the music or audio clip.

20 Claims, 5 Drawing Sheets

GREETING CARD WITH SCROLLING SCENE

RELATED APPLICATIONS

This application claims priority to U.S. Provisional Patent Application No. 61/919,515, filed on Dec. 20, 2013, a copy of which is incorporated herein by reference in its entirety.

FIELD OF THE INVENTION

The present invention is in the field of social expression products and more specifically, greeting cards.

SUMMARY OF THE INVENTION

The greeting card of the present invention contains a motor module and scroll mechanism which together cause a scenic picture to be scrolled across a miniature screen on an inside surface of the greeting card. A sound module also provides audio playback upon activation. The scenic picture is printed on a thin substrate which is attached at each free end forming a closed loop. The material is placed between two rollers which are in contact with a gear mechanism that is put into motion when the motor module is activated. In addition to the moving scenic picture, a die cut shaped character is attached to a spring and located proximate to the moving scenic picture such that when the motor module is activated, the vibration from the motor causes the die cut shaped character to wobble or bounce on the spring, giving the illusion that the die cut shaped character is interacting with the moving scenic picture.

DETAILED DESCRIPTION OF PREFERRED AND ALTERNATE EMBODIMENTS

Figure 1:
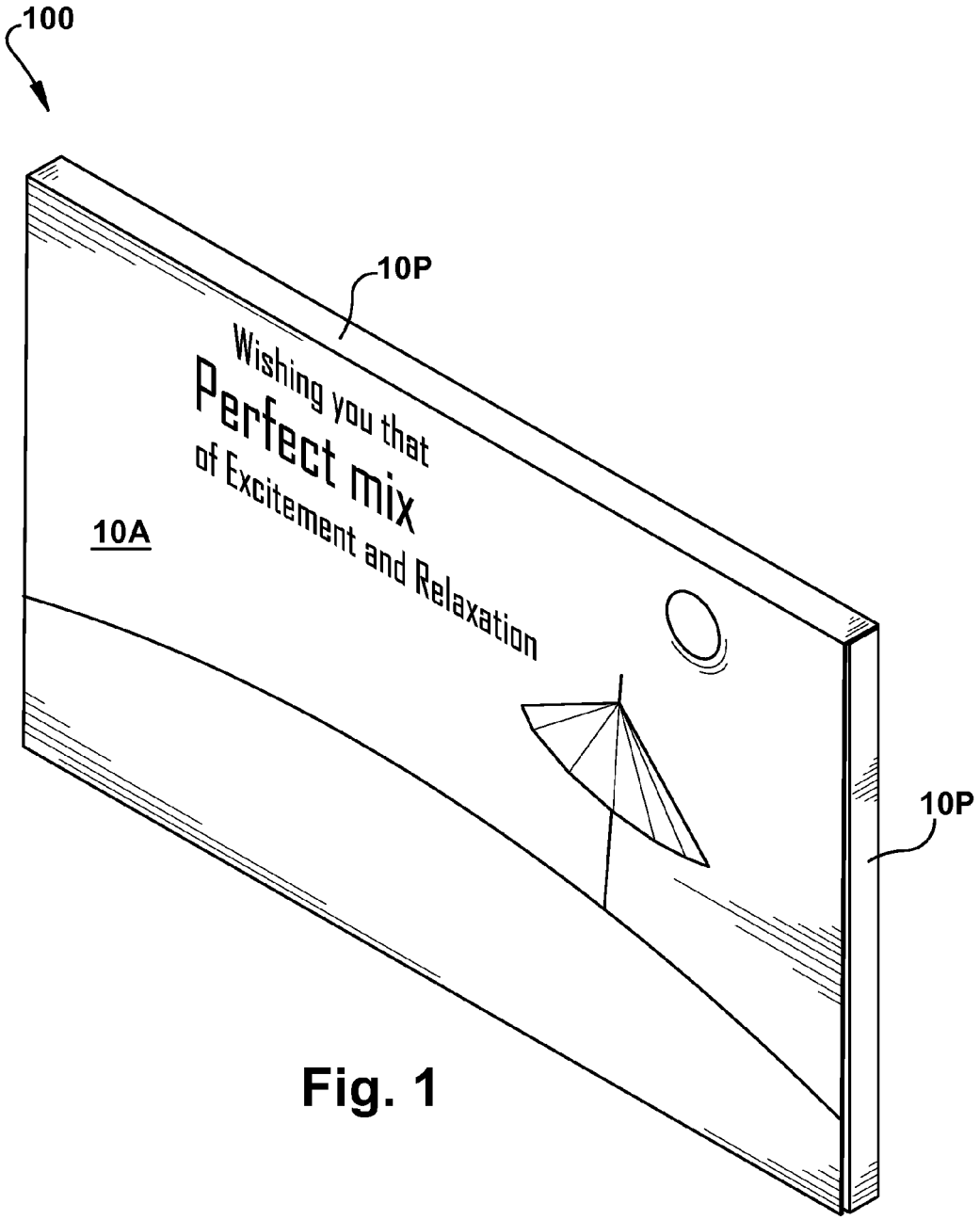
FIG. 1 is a perspective view of the greeting card of the present invention, in a closed position.
Figure 2:
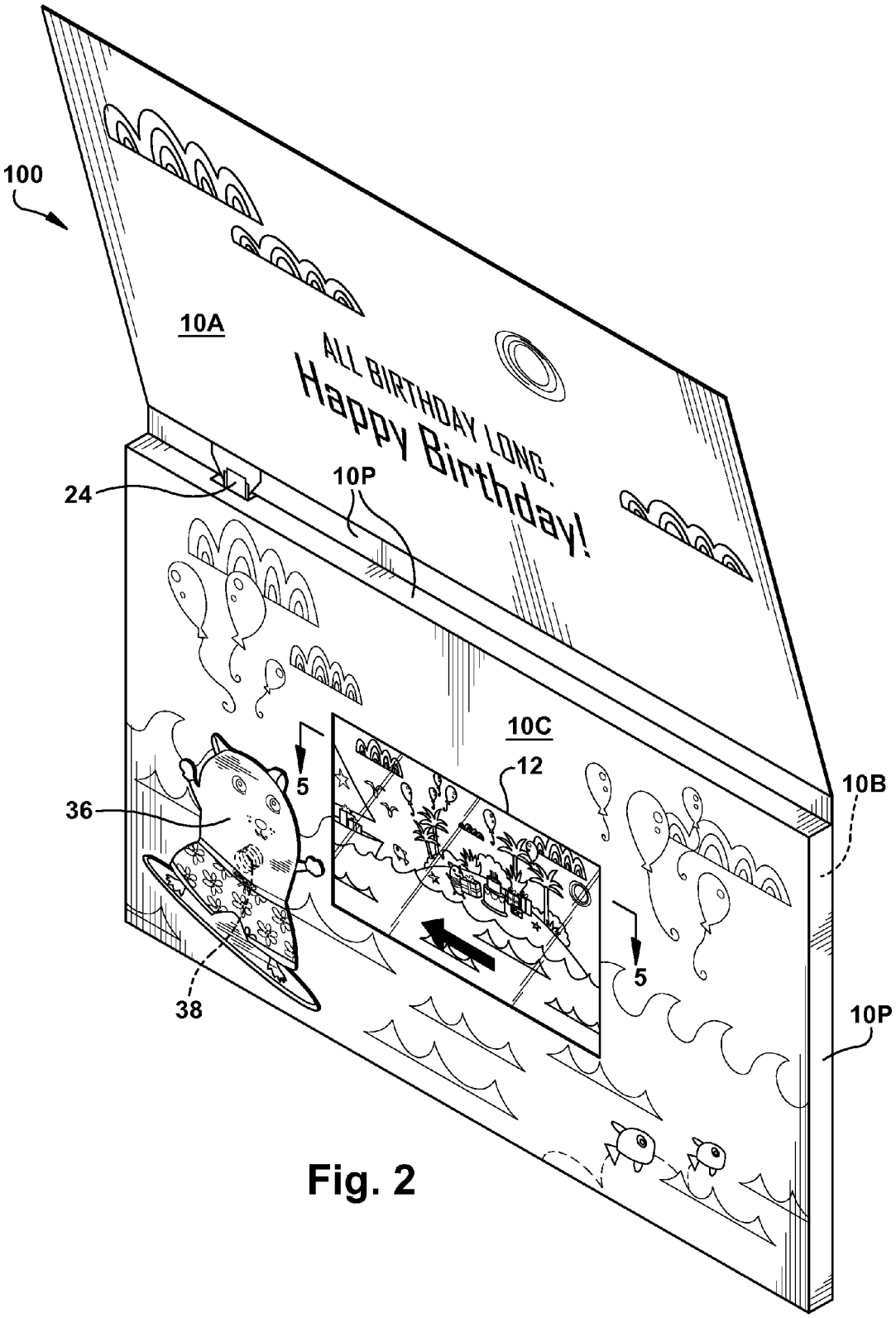
FIG. 2 is a perspective view of the greeting card of FIG. 1, in an open position.
Figure 3:
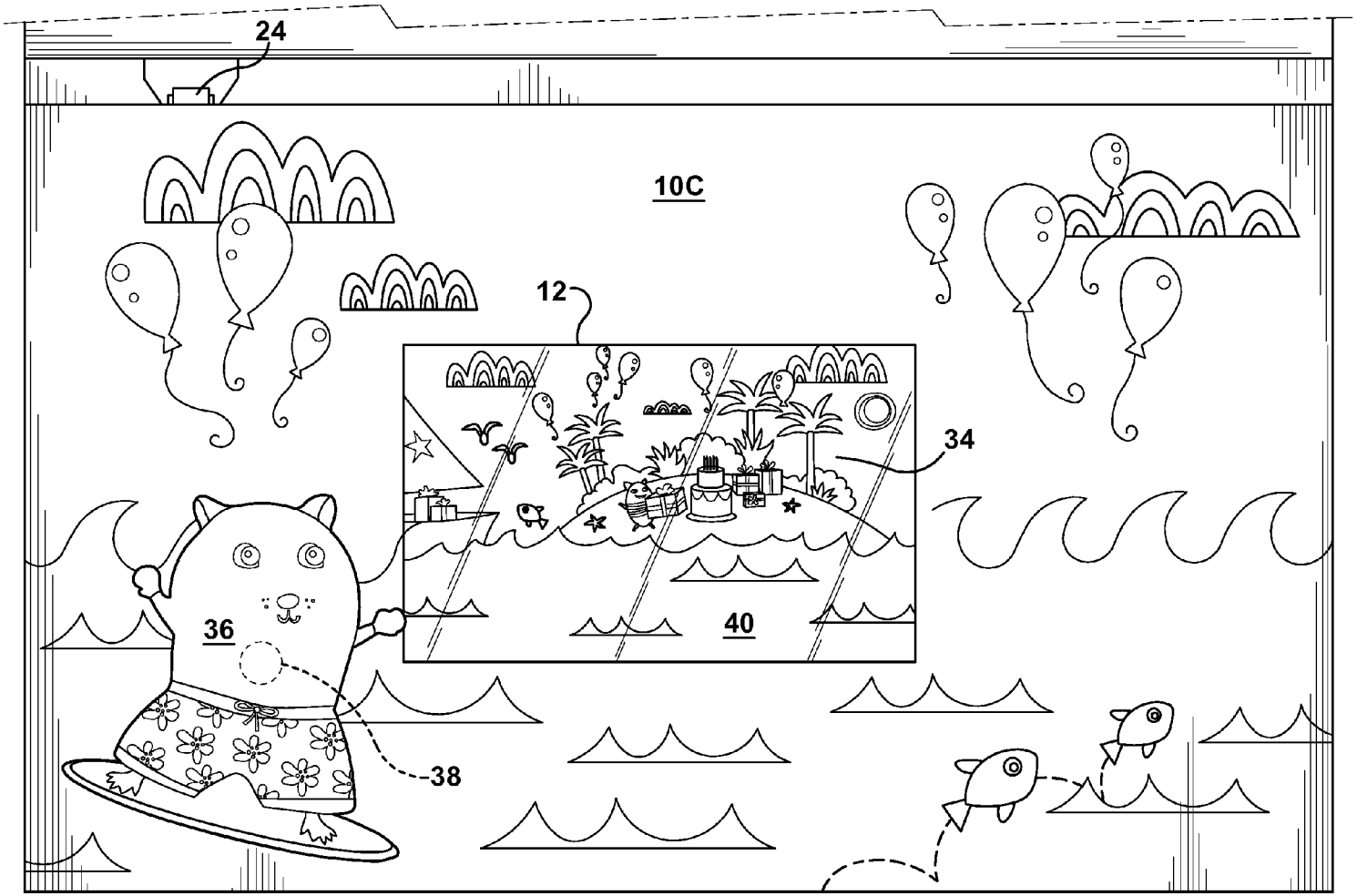
FIG. 3 is a front view of an inside panel of the greeting card of FIG. 1.
Figure 4:
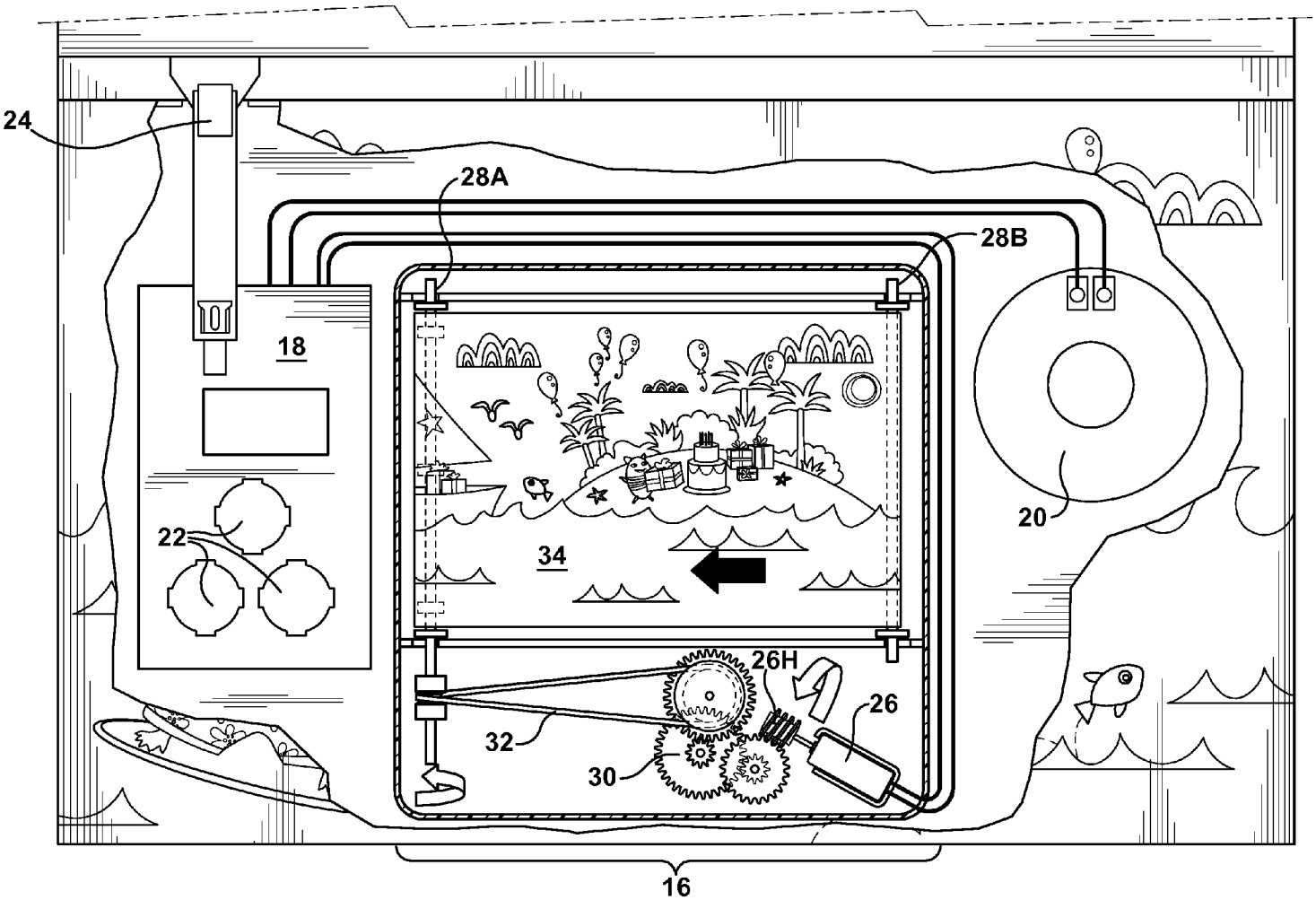
FIG. 4 is a tear-away view of the inside panel shown in FIG. 3.
Figure 5:
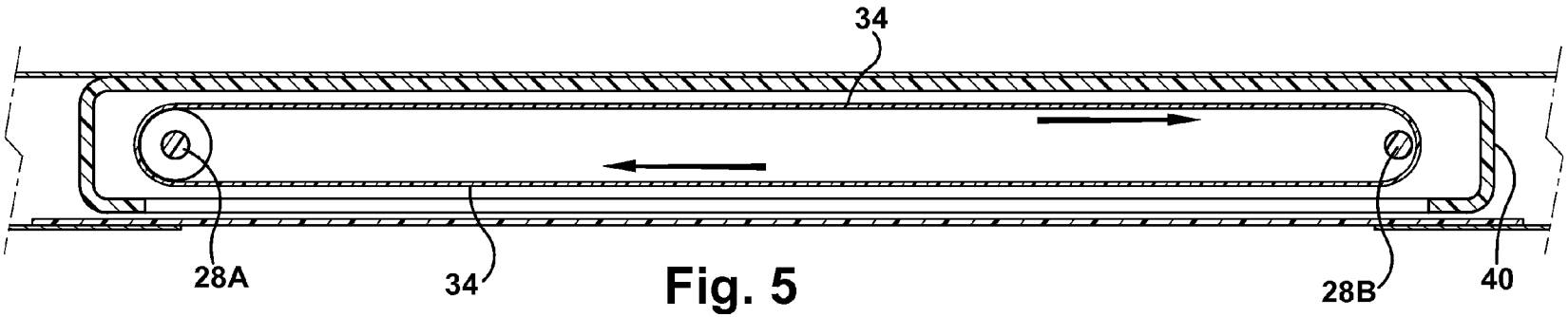
FIG. 5 is a cross-sectional view of the scroll mechanism of FIG. 2, from the perspective of arrows 5-5.

The greeting card of the present invention includes a sound and motor module which enable the greeting card to play audio and activate a scroll mechanism which displays a scrolling scene across a window or screen located on at least one panel of the greeting card. The scroll mechanism contains a piece of thin paper or paper-like material which is attached end-to-end, forming a loop. The material is then placed between two spindles or rollers which rotate the material in a loop across the greeting card page as a moving picture, scene or message. The scroll may contain a greeting, message or simply contain artwork or a funny or entertaining scene. The information on the scroll may be coordinated with the theme of the music or audio clip.

The greeting card 100 includes a multi-panel greeting card body having two or more panels 10 connected along various fold lines. The panels 10 may be main panels or side panels which cover the sides or thickness of the greeting card 100 around the perimeter. The panels 10 may be made of typical greeting card material such as paperboard or may be of a heavier card stock. The panels 10 of the greeting card 100, in a preferred embodiment, are contained in a single contiguous sheet which is folded along the various fold lines to wrap or envelope the inner components of the greeting card 100. However, the greeting card 100 may be comprised of two or more separate panels which are attached together around the inner components of the greeting card 100. Each of the panels 10 may contain printing thereon such as text sentiment, artwork, drawings, photos or even three-dimensional embellishments attached thereto. The greeting card panels 10 may be arranged in a standard portrait orientation or may also be arranged in a landscape orientation which provides more space for the internal components to be attached along the width of one or more greeting card panels 10. In a preferred embodiment, the greeting card contains a first main panel 10A, a second main panel 10B and a third main panel 10C. Smaller, narrow side or perimeter panels 10P are located between each of the main panels and also along the side edges of the third main panel 10C. The third main panel 10C contains an opening 12 thereon through which the scrolling mechanism 14 can be viewed. The opening 12 may be of any shape and size but in a preferred embodiment, the opening 12 is a rectangular shaped opening 12 located proximate to the center of the greeting card panel 10B. The sides of the opening 12 may be linear or non-linear and decorative, like a picture frame. The opening 12 may contain a clear or transparent sheet of acetate or other transparent material 40 thereon, through which the scrolling mechanism 14 is viewed. The transparent material 40 protects the scrolling mechanism 14 from damage while still providing visibility therethrough. Each of the main greeting card panels 10A, 10B, 10C and the side or perimeter panels 10P contain a front surface and a rear surface opposite the front surface. A foam frame 16 is inserted between the second 10B and third 10C main greeting card panels. The second 10B and third 10C main greeting card panels along with the side or perimeter panels 10P cover or envelope and conceal the foam frame 16 therebetween. The foam frame 16 creates a thickness which is wide enough to contain the internal components of the greeting card while maintaining a planar outer surface.

Contained between two main greeting card panels 10B, 10C are the electronic and other internal components of the greeting card 100. These components may be attached directly to the one of the greeting card panels 10B, 10C or may be attached to a substrate which is then attached to one of the greeting card panels 10B, 10C. These components may include, but are not limited to: a printed circuit board 18, an integrated circuit chip, a speaker 20, a power source 22, a switch 24, a motor 26; a scroll mechanism 16 with attached paper or paper-like material wound about a portion of the scroll mechanism.

The scrolling mechanism contains a two spindles or rollers 28A, 28B, a small motor 26, a gear mechanism 30, a rubber band 32, and a scroll sheet 34 which is attached end to end, forming a loop. The entire scrolling mechanism 16 is contained within a hard plastic shell 40. The miniature motor 26 contains a small gear head 26H which when activated spins or rotates. The gear head 26H is in contact with at least one of a plurality of gears 30 contained in the gear mechanism. Once the motor 26 is activated the gear head 26H rotates, causing the gears 30 of the gear mechanism to rotate as well. Two spindles or rollers 28A, 28B are positioned parallel to and spaced apart from each other at a distance that is approximately equal to the width of the scroll sheet loop 34. A small rubber band 32 is looped at one end around one of the gears 30 and at the opposite end around one of the rollers 28A. The scroll sheet loop 34 is attached between the two rollers or spindles 28A, 28B. Therefore, when the motor 26 is activated, the gear head 26H turns the gears 30 in the gear mechanism which in turn causes rotation of one of the spindles or rollers 28A, 28B via the rubber band 32. The scroll sheet 34 then scrolls or loops continuously between the two rollers 28A, 28B for as long as the motor 26 is activated. The scroll sheet loop 34 is made of a very thin material which has a pleasant scene or message printed thereon. The scene is printed from one edge of the film to the opposite edge. The two vertical ends or edges of the material 34 are attached to one another, forming a loop. Once the loop 34 is attached between the rollers 28A, 28B and the motor 26 is activated, the material 34 scrolls across the "screen" from left to right and is visible through the opening 12 in the greeting card panel 10B and the acetate screen or cover. The scroll material loop 34 continues to rotate about the two rollers 28A, 28B until the motor module 26 is deactivated. The motor module 26 is activated by a slide switch 24 which is located between two main greeting card panels such that when the greeting card 100 is opened by pivoting one greeting card panel 10A away from the other 10C, the slide tongue moves, causing activation of the motor 26 and movement of the scrolling scene 34. When the greeting card 100 is closed by pivoting the greeting card panel 10A back over the other panel 10C, the motor 26 becomes deactivated. In addition to the motor 26, the slide switch 24 also controls activation of a sound module which is operative to store and playback at least one audio clip. Therefore, when the greeting card 100 is opened, both the motor 26 and sound modules are activated causing movement of the scrolling scene 34 and playback of audio. In an alternate embodiment, a push button switch may be used to control activation of the sound and motor modules. The push button switch may be accessed through the front cover of the greeting card or any other panel of the greeting card. Likewise, other types of switches may be used.

On an inside panel of the greeting card 10B, proximate to the opening 12 through which the scrolling scene 34 is visible, a die cut shape 36 is attached to a spring 38 which is attached to the greeting card panel 10B. The vibration caused from the motor 26 moving the scroll 34 between the two rollers 28A, 28B, causes the die cut shape 36 to vibrate or wobble at the end of the spring 38. The die cut shape 36 and the scrolling scene 34 may be designed as part of a larger scene. For example, the scrolling scene 34 may depict a road running through a town or city with buildings, trees, houses, etc. in the background. The die cut shape 36 may look like a person sitting in a little car so when the die cut shape 36 bounces or vibrates on the spring 38 when the motor 26 is activated, it gives the appearance that the person in the little car is traveling along the road depicted in the scrolling scene 34. As another example, as shown in the figures, the scrolling scene 34 may contain body of water with an island, trees, birds, and boats in the background. The die cut shape 36 may be a person in on a surfboard so that when the motor 26 is activated it appears as if the surfer is surfing on the water in the scene. Of course, the greeting card panel 10B may also contain artwork which blends in with the scenery of the scrolling scene 34 and the die cut shape 36. The audio clip may also be coordinated with the theme of the scrolling scene 34, die cut shape 36, and greeting card 100.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

The invention claimed is:

1. A greeting card comprising:
a multi-panel greeting card body;
a scrolling mechanism contained within an enclosure, the scrolling mechanism comprising a scenic picture printed on a thin material which is attached end-to-end forming a loop and attached between two rollers spaced apart from and parallel to one another, a gear mechanism and a rubber band attached between one of the two rollers and the gear mechanism;
a motor module which is in contact with the gear mechanism;
a sound module operative to store and playback at least one audio file;
wherein the sound and motor modules are activated upon a user opening the greeting card, causing the at least one audio file to be replayed and the motor module to cause movement of scenic picture between the two rollers.

2. The greeting card of claim 1, wherein the scenic picture is visible through an opening on at least one panel of the multi-panel greeting card body.

3. The greeting card of claim 1, wherein the scenic picture is visible through an opening on an inside panel of the greeting card.

4. The greeting card of claim 1, wherein the sound and motor modules are deactivated when the greeting card is closed.

5. The greeting card of claim 1 further comprising a transparent panel over the scenic picture.

6. The greeting card of claim 1 further comprising a die cut shape attached to a spring which is attached to an inside panel of the greeting card.

7. A greeting card comprising:
a multi-panel greeting card body;
a scroll mechanism contained within the multi-panel greeting card body, the scroll mechanism comprising:
two spindles positioned parallel to and spaced apart from one another;
a thin sheet material attached in a loop around the two spindles;
a motor module operative to cause rotational movement of at least one of the two spindles causing the thin sheet material to rotate around the two spindles;
a switch which controls activation of the motor module;
wherein a portion of the thin sheet material is visible through an opening on at least one panel of the multi-panel greeting card body.

8. The greeting card of claim 7 further comprising a sound module operative to store and playback at least one audio file.

9. The greeting card of claim 8, wherein the switch also controls activation of the sound module.

10. The greeting card of claim 7, wherein the thin sheet material contains a scene printed thereon which is complementary to printing on the multi-panel greeting card body.

11. The greeting card of claim 7, wherein the switch is a slide switch.

12. The greeting card of claim 7, wherein the switch is activated upon opening the greeting card.

13. The greeting card of claim 7 further comprising a die cut shape attached to a spring which is attached to an inside panel of the multi-panel greeting card body.

14. The greeting card of claim 7, wherein closing the greeting card deactivates the motor module.

15. The greeting card of claim 7 further comprising a transparent cover across the opening on at least one panel of the multi-panel greeting card body.

16. A greeting card comprising:

a multi-panel greeting card body, at least one panel having an opening thereon;

a scroll mechanism comprising a scene printed on a thin sheet material attached between and around two rollers, the scroll mechanism contained within the multi-panel greeting card body and the scene visible through the opening on the at least one panel;

a motor module which is attached to at least one of the two rollers and operative to cause rotation to the at least one of the two rollers;

a switch which controls activation of the motor module;

wherein activation of the motor module causes the scene to rotate around and between the two rollers.

17. The greeting card of claim 16 further comprising a sound module operative to store and playback at least one audio file.

18. The greeting card of claim 17, wherein the switch controls activation of the sound module.

19. The greeting card of claim 17, wherein the sound module is activated upon opening the greeting card.

20. The greeting card of claim 17, wherein the motor module is deactivated upon closing the greeting card.

* * * * *